US007053291B1

(12) United States Patent
Villa

(10) Patent No.: US 7,053,291 B1
(45) Date of Patent: May 30, 2006

(54) COMPUTERIZED SYSTEM AND METHOD FOR BUILDING MUSICAL LICKS AND MELODIES

(76) Inventor: Joseph Louis Villa, 12017 89th Pl. NE., Kirkland, WA (US) 98034

( * ) Notice: Subject to any disclaimer, the term of this patent is extended or adjusted under 35 U.S.C. 154(b) by 0 days.

(21) Appl. No.: 10/935,051

(22) Filed: Sep. 7, 2004

Related U.S. Application Data

(63) Continuation-in-part of application No. 10/429,999, filed on May 5, 2003, now abandoned.

(60) Provisional application No. 60/501,258, filed on Sep. 10, 2003, provisional application No. 60/380,114, filed on May 6, 2002.

(51) Int. Cl.
*G10H 1/00* (2006.01)

(52) U.S. Cl. ..... 84/609; 84/649

(58) Field of Classification Search ..... 84/609–614, 84/649–652

See application file for complete search history.

(56) References Cited

U.S. PATENT DOCUMENTS

| | | | | | |
|---|---|---|---|---|---|
| 4,441,399 | A * | 4/1984 | Wiggins et al. | ..... | 84/470 R |
| 4,616,547 | A * | 10/1986 | Mancini et al. | ..... | 84/611 |
| 5,155,286 | A * | 10/1992 | Saito et al. | ..... | 84/611 |
| 5,182,414 | A * | 1/1993 | Takahashi | ..... | 84/634 |
| 5,220,121 | A * | 6/1993 | Kawashima | ..... | 84/664 |
| 5,281,754 | A * | 1/1994 | Farrett et al. | ..... | 84/609 |
| 5,451,709 | A * | 9/1995 | Minamitaka | ..... | 84/609 |
| 5,859,379 | A * | 1/1999 | Ichikawa | ..... | 84/609 |
| 6,100,462 | A * | 8/2000 | Aoki | ..... | 84/613 |
| 6,124,543 | A * | 9/2000 | Aoki | ..... | 84/609 |
| 6,245,984 | B1 * | 6/2001 | Aoki et al. | ..... | 84/611 |
| 6,294,720 | B1 * | 9/2001 | Aoki | ..... | 84/611 |
| 6,372,973 | B1 * | 4/2002 | Schneider | ..... | 84/609 |

OTHER PUBLICATIONS

Cakewalk Professional for Windows. Release 2.0 User's Guide.*

Cakewalk Professional for Windows. Release 2.0 User's Manual. See newly cited pp. 160 and 161.*

Harmony Central, www.harmony-central.com/software/windows/mostlytonal.html.

Band in a Box, //bandinabox.com.

Cakewalk, //cakewalk.com/Products/homestudio/default.asp.

Carmapro, www.carmapro.com/music/carmamusic/ibinfo.html.

* cited by examiner

*Primary Examiner*—Marlon Fletcher
*Assistant Examiner*—David S. Warren
(74) *Attorney, Agent, or Firm*—James L Davison

(57) ABSTRACT

The present invention implements a method that can most easily be thought of as having three major components. They are creating, building, and maintaining musical licks or melodies. Several unique algorithms along with other application functionality, including MIDI, make up these components. A brief description of each component follows.

Creating Melodies—This component implements a set of algorithms for the purpose of forming melodic-parts. They are a) combinations and permutations, b) Lickparts, and c) scales which are created through the use of partitions and permutations. Each algorithm provides a unique approach to forming melodic-parts, each yielding different results.

Building Melodies—Identifies a) scales or modes for harmonic usage of melodic-parts when the user has not previously designated a particular use, b) allows the user to combine melodic-parts, and also c) concatenate those melodic-parts to form longer new melodies. Additionally, to facilitate the process of building a musical lick or melody, rhythm tracks can be synchronized to play with selected portions of the melody as it is being created.

Maintaining Melodies, implements the notion or concept of a lick-library by using functionality for saving and updating melodies that have been previously created and built.

2 Claims, 8 Drawing Sheets

COMPUTERIZED SYSTEM AND METHOD FOR BUILDING MUSICAL LICKS AND MELODIES

CROSS-REFERENCE TO RELATED APPLICATIONS

This application is a Continuation-In-Part of application Ser. No. 10/429,999, filed May 5, 2003, now abandoned, which claims the benefit of U.S. Provisional Application No. 60/380,114 filed May 6, 2002, and the new material added to this C-I-P claims the benefit of U.S. Provisional Application No. 60/501,258 filed 2003 Sep. 10.

BACKGROUND—FIELD

The present invention is in the field of making and storing for audible playback, combinational musical notes using a microprocessor-based system.

BACKGROUND—DESCRIPTION OF RELATED ART

Today, vendors supply the market place with music software applications that provide musicians a wide range of tools to choose from. Perhaps because the art of melody is complicated, there is not a software tool currently in the market place that gives users a powerful and comprehensive way to create and build melodies, as does the present invention.

Sequencers can easily record a melody that is played on a MIDI keyboard for example, as well as import a melody. However, sequencers do not provide you with choices of notes to use in building a melody. That is left up to the user as well as the process of constructing the melody and the harmonic definition.

In another example, U.S. Pat. No. 5,990,407 (1999), is a system and method for generating new musical improvisations. However, with this system, the user plays a small part in the creation of the melody. With this system and method users can only select various options that affect the outcome of the improvisations that are generated. For this reason, the degree of originality of a melody or improvisation is comprised with the abundance of automation.

One tool in the market place, Lick Builder™, provides output that a user can manually explore with a musical instrument for example. With a mouse, a user selects up to four notes on a keyboard map. A list of permutations can then be generated for the notes that were entered. This process can be repeated for up to eight iterations and the results of each can then be displayed, printed, and saved to file. Unfortunately, with this application, there is not nearly enough functionality to facilitate the process of building licks efficiently and effectively.

With this tool, there are several limitations. For example, it is up to the user to know or determine the harmonic use of the permutation. Conversely, with the present invention, various possible harmonic uses for every permutation are automatically determined. Another limitation of the tool is that you cannot select and play any of the permutations to determine if you like the way it sounds. Nor can you select and save permutations that you prefer. The absent functionality is necessary because with permutations, users need a means to manage the great number of possibilities.

Additionally, manually entering permutations is a very slow process. However with the present invention, this problem is overcome by first generating a list of combinations of notes for selected parameters. Items from this list can be selected and played. Any of these combinations can be added to a user maintained list of combinations. Subsequently, permutations can be generated for any of these combinations.

Several advantages of the present invention are:

(a) Since mathematical algorithms are used in initialing creating scales, combinations, and permutations, users are enabled to explore a very wide range of melodic and harmonic possibilities.

(b) Through the use of from-lists and to-lists, users can manage large amounts of data over time. To-lists are user maintained lists which can be updated. From-lists provide the source of data from which to choose from.

(c) Permutations or Lickparts, or both, can be used to build a musical lick or melody. In General, permutations represent what is not known, and Lickparts represent what the user knows.

(d) Using a tool of choice found in the market place, such as a sequencer program, users create their own rhythm tracks. Subsequently, the tracks can then be read by the current invention. To facilitate the process of building a musical lick or melody, the rhythm tracks can be synchronized to play with selected portions of the melody as it is being created.

SUMMARY

The goal of this invention is to provide a comprehensive means from which to build musical licks or melodies. In part this is accomplished by concatenating musical permutations of notes or Lickparts that populate a from-list, which is simply a list that users can select items from. It then serves as a source of data where any user selected items in the from-list can be added to a to-list so that the items in the to-list then comprise the musical lick or melody.

Other key objectives needed to accomplish this goal and that comprise this method are:

(a) Enable the user to create and build a source list of musical scales using numerical partitions, and permutations of partitions, for selected parameters, so that selected scales can be added and saved in a user maintained list of preferred scales. Creating and building musical scales using mathematical algorithms generates every possible scale for a given set of parameters. Since scales are used to determine the harmonic use of a permutation, the desired harmonic use of any permutation can be obtained.

(b) Enable the user to create and build a source list of musical combinations of notes using numerical combinations for selected parameters so that selected musical combinations can be added and saved in a user maintained list of preferred musical combinations.

(c) Enable the user to create and build a source list of musical permutations of notes using numerical permutations for any musical combination found in any list of preferred musical combinations, so that selected musical permutations can be added and saved in a user-maintained list of preferred musical permutations (d) Enable the user to create and maintain a list of preferred Lickparts for any created by the user as described in the present invention.

(e) Enable the user so that for any user maintained list of musical permutations, the harmonic use of those permutations is determined by searching a user maintained list of musical scales.

(f) Enable the user to save musical licks and melodies so that they can be saved to disk and read from disk for editing.

(g) Enable the user to build a musical lick or melody using rhythm tracks that are synchronized with either a selected portion, or all of the melody.

Vocabulary and Special Terms

Chord—A simultaneous combination of three of more notes of different pitch that form an entity. Chords are constructed from and associated with scales.

Chord Tones—The root, major or minor $3^{rd}$, flatted, natural, or augmented $5^{th}$, and flatted or natural $7^{th}$ of a chord as related to the scale from which they are constructed.

Chord Tensions—Any scale tone that is not a chord tone.

Chord Type—A name qualifier used to group related chords, or names a specific type of chord. The chord type mi7th can imply other related types like mi7th 9 and mi7th 9 11. Or it can simply mean specifically a mi7th.

Chromatic Scale—A twelve tone scale consisting of only chromatic tones. The note names in ascending sequence are C, C# or Db, D, D# or Eb, E, F, F# or Gb, G, G# or Ab, A, A# or Bb, and B. Chromatic scale numbering corresponds to the note names. So for the preceding note names, the number sequence is 1, 2, 3, 4, 5, 6, 7, 8, 9, 10, 11, and 12.

Combination—For a given number of notes, a grouping of musical notes is taken from a scale. For example, let S be a set. Then an unordered arrangement of k elements of S, that is, a subset of S of size k, is also called a combination of size k, or a k-combination taken from S.

From-list—Any list that stores a set of items where each item consists of elements and where the items in the list serve as a source of data. And, that any element in any item in any from-list is the equivalent of a musical note.

Half Step—See semi-tone.

Harmony—The style of a composition considered with respect to the chords employed and the principles governing their succession.

Interval—The distance in pitch between two tones, simultaneous or successive. Intervals are measured by scale degrees or steps, counting both the first and last tones; thus, C to E is a major third interval, and D to G is a perfect $4^{th}$ interval, and so on.

Key—A tone (including its duplication in any octave) to which the other tones of the octave stand in subordinate relation.

Keyboard Map—A keyboard map is a graphical representation of a musical instrument's keyboard or fingerboard that shows the location of notes.

Lick—A short melody. Intuitively, has a beginning and ending and stands on its own merit to the trained musical ear. May or may not suggest harmony. Can be thought of as a kind of statement, or what a sentence is to a paragraph for example.

MIDI Musical Instrument Digital Interface—A specification for connecting musical instruments together to transfer data. Most modern electronic instruments are equipped with MIDI hardware. PCs require a MIDI interface, similar to a serial port, to be able to access external keyboards and sound modules. Most sound cards provide a simple MIDI interface—requiring a special cable to connect to the real world—as well as an on—board synthesizer that is MIDI compatible.

MIDI Note Decimal Value—A decimal value that is assigned to a data element of a MIDI event structure so that a particular note will sound.

Numerical Partition—A numerical partition of an integer n is a sequence $p_1 \geqq p_2 \geqq \ldots > p_k > 0$, such that $p_1+p_2+\ldots+p_k=n$. Each $p_i$ is called a part. For example, 7+4+4+1+1+1 is a partition of 18 into 6 parts. The number of partitions of n is denoted p(n) and the number of partitions of n into k parts is denoted p(n,k).

$$p(n,k)=p(n-1,\ k-1)+p(n-k,k)$$

Object—An object results from instantiating a class definition at run time. A class definition contains methods and attributes. Methods provide processing functionality and attributes are the entity's characteristics.

Octave—The eighth tone above a given pitch, with twice as many vibrations per second, or below a given pitch, with half as many vibrations.

Permutation—Permutations are concerned with the different ways of ordering notes and are created using a mathematical algorithm.

Root—Identifies the note name of a chord or scale.

Scale—A sequenced arrangement of step-wise tones where the next tone is always the next higher pitch. Most often scales are constructed using not less than five tones, and the sequence of tones repeats in the next octave. Some common scale names are Pentatonic, Whole-Tone, Dorian, Mixolydian, Major, Melodic Minor, Harmonic Minor and Diminished scales for example.

Semi-Tone—An interval or distance of one half-step which is the smallest distance possible in a scale.

To-list—Any list that stores a set of items where each item consists of elements and where a from-list serves as a source of items that populate the to-list. And, that any element in any item in any to-list is the equivalent of a musical note.

Tone—A musical sound of definite pitch.

Transpose—Any note can be transposed to another key (see "key"). There are 12 keys. If a series of notes are transposed to another key, an interval relationship between the two series of notes remains constant. For example, all notes would remain the same distance or interval apart in both series of notes.

Whole Step—Two semi-tones or half steps.

BRIEF DESCRIPTION OF THE DRAWINGS

The invention is further described in connection with the accompanying drawings, in which:

FIG. 5 shows a guitar keyboard map as well as a from-list and a to-list. The from-list, shown on the left, contains permutations that serve as a source of notes to add to the to-list. Because the note "F" was clicked on the keyboard map, all of the permutations in the from-list are filtered to begin with the note "F" as well. The to-list is shown on the right side of the screen. Asterisks are displayed on the keyboard map indicating scale tones for the selected scale and root. The selected root determines which key the scale is in. Additionally, a sequence of numbers shows the order that notes are played or sound in.

DETAILED DESCRIPTION

Figure 1A:
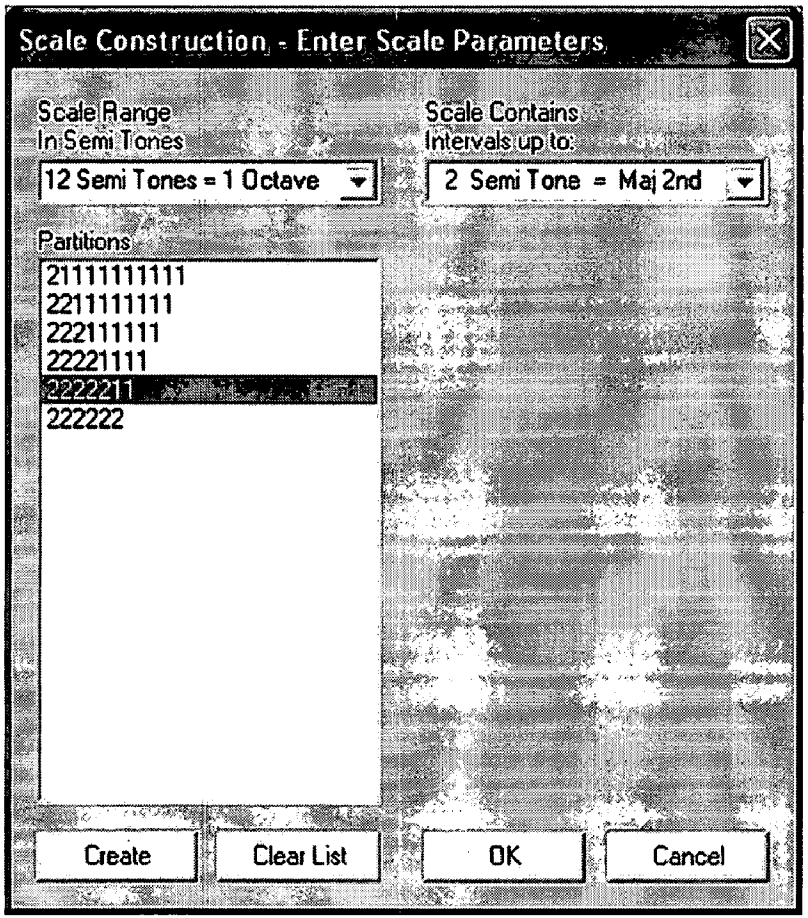
FIG. 1*a* shows a scale construction dialog box. A scale range of one octave is selected as well as a major $2^{nd}$ interval. A list of partitions is displayed for the two selected parameters.

In the present invention, a music software application is intended to run on a PC computer. To accomplish this, the following hardware and software specifications for an IBM compatible PC are provided.

Genuine Intel Pentium 266 MHz, AMD K6300 MHz or faster processor

Intel, AMD or 100% compatible motherboard chipset

64 MB RAM (128 MB recommended)

600 MB of free hard disk space

Available PCI 2.1 compliant slot for the Sound Blaster Audigy card

Available 5¼" drive bay for a Audigy Drive

CD-ROM drive installed.

Headphones or amplified speakers

Compatible Mouse, Keyboard, and Monitor

Sound Blaster Audigy software used with one of the following operating systems;

Windows 98 Second Edition (SE), Windows Me, Windows NT 4.0, Windows 2000, or Windows XP.

Furthermore, these hardware and software specifications should be used as a guideline in determining the proper specifications for other PC computer brands such as Macintosh.

In the present invention, MIDI is implemented as described in the book "Maximum MIDI" by Paul Messick. The book discusses music applications in C++. Publishing information is as follows. Manning Publications Co., 1998, ISBN 1-884777-44-9.

In addition to the discussion in Messick's book, several sample programs are included which provide most if not all of the necessary functionality to implement MIDI in the present invention. Two examples of particular interest can be found in chapter 12 "A Simple Sequencer", and chapter 14 "Enhancing the Sequencer". Reading and writing MIDI files, recording, play-back, and other functionality commonly found in sequencers is thoroughly described in these examples.

In the present invention, scales, combinations, permutations, Lickparts, and musical licks or melodies that are created, are played in this way so that they can be heard through audio speakers.

Equivalent MIDI note decimal values correspond to note names and chromatic scale numbering. For example, the Midi note decimal value 60, which is middle "C" when played, corresponds to the note name "C", and also to the number 1 which is the first step of the chromatic scale. And, the Midi note decimal value 61 corresponds to the note name "Db", and the number 2 which is the second step of the chromatic scale.

Similarly, other equivalent values are identified for a two octave range of the chromatic scale. For any note name that is duplicated in the second octave of the chromatic scale, an up-arrow character is appended to the note name when displayed in the user interface. For example, CA indicates to the user that the note is "C" above middle "C". And "Db" above middle "C" is indicated as "Db^".

Because scales, combinations, and permutations that are created use chromatic scale numbering, the equivalent MIDI note decimal values can be used to fill a string array. Lickparts do not use chromatic scale numbering since the notes that comprise a Lickpart are captured as MIDI note decimal values and subsequently are used to populate the elements of a string array.

In either case, the string array containing MIDI note decimal values is passed to an object that creates MIDI events for each decimal value in the string. Each MIDI event is inserted into a track and the track is then played.

Scales—In the present invention, scales are used to determine the harmonic use of musical combinations and permutations of notes. For example, a C maj7th chord is constructed from a C major scale. Therefore any combination of notes or permutations of any combinations found in the C major scale can then be used as part of a musical lick or melody to be played or used with a C maj7th chord. In another example, a C mi7th chord is constructed from the C Dorian scale. Again, any combination of notes or permutations of any combinations found in the C Dorian scale can then be used to as part of a musical lick or melody to be played or used with a C mi7th chord.

As is well known in the art, an algorithm is used to generate a list of numerical partitions for a given set of parameters. Also, as is well known in the art, an algorithm is used to generate lists of permutations for a given set of numbers for example. In the present invention, partitions and permutations that are generated are used in the following way.

Numerical partitions and permutations are used to create and build scales. In order to construct scales, first we must generate a list of partitions for selected parameters (FIG. 1*a*). The number of partitions of n into k parts is denoted p (n, k). Two parameters are specified.

The first parameter "n" represents the total number of semi-tones that will determine the range of any scales created from partitions. Thus the sum of the parts or intervals in our case forms the scale range. For example, 12 minor 2nd intervals form an interval or scale range of an octave. The second parameter, an interval, limits the value of any part to "k" and requires that the value of "k" will appear in every partition—lesser values of "k" may also appear.

The resulting partitions are used to construct scales. Numeric values used to create partitions are translated to interval values so that 1=a min $2^{nd}$, 2=a major $2^{nd}$, 3=a minor $3^{rd}$, and so on. Therefore each part of the partition is interpreted as an interval.

To further illustrate this: 2+2+2+2+2+1+1 is a partition of 12 sequential semi-tones, forming the chromatic scale into 7 parts where 2 is comprised of 2 semi-tones, and 1 is a single semi-tone or half step.

Scales are constructed by creating permutations for a selected partition. Each permutation uniquely reorders the parts of the partition. Since the parts are interpreted as intervals, unique scales are then constructed from each permutation. The root or first note of every scale constructed is middle "C" and has a MIDI note decimal value of 60. The sequence of intervals contained in each permutation of a partition is then used to determine the corresponding sequence of scale tones that follow the root.

For example, if the first interval of the permutation is a major 2nd, then the second note of the scale being constructed is "D" and will have a MIDI note decimal value of 62. If the second interval of the permutation is a minor 2nd, then the third note of the scale is E flat and will have a MIDI note decimal value of 63. Subsequent scale steps are constructed in the same way for each of the intervals contained in the permutation.

Figure 1B:
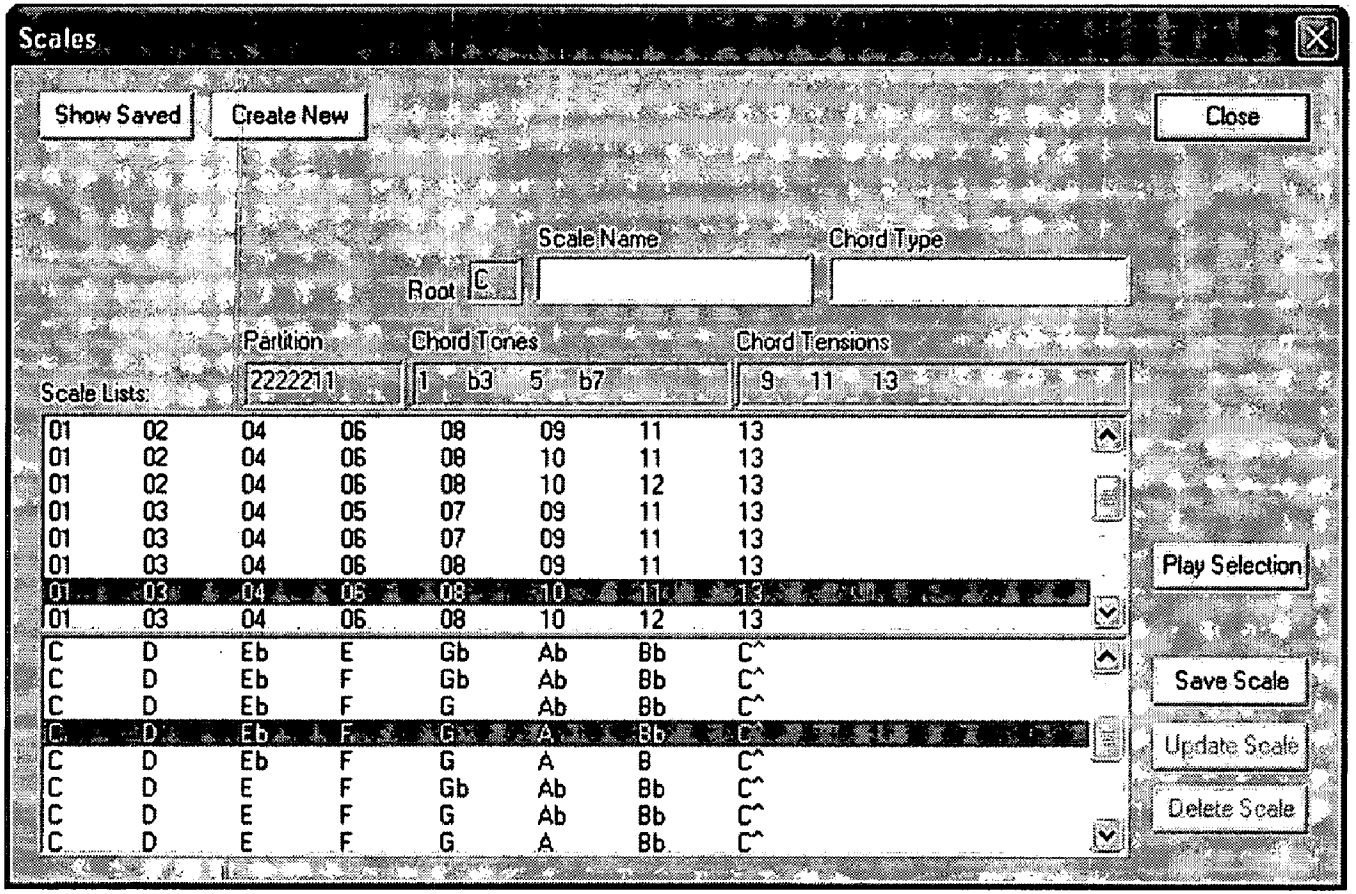
FIG. 1*b* shows a scale dialog box with from-lists that are populated with scales. The lists contain equivalent items. The selected items in the lists are equivalent.

Scales that are created are then formatted and displayed in from-lists in a dialog box so that both chromatic scale numbering and equivalent note names can be shown (FIG. 1*b*). The from-list using chromatic scale numbering is sorted from low to high where the lowest item appears first in the list. The from-lists maintain synchronization so that equivalent items are sequentially displayed in the same order.

Figure 1C:
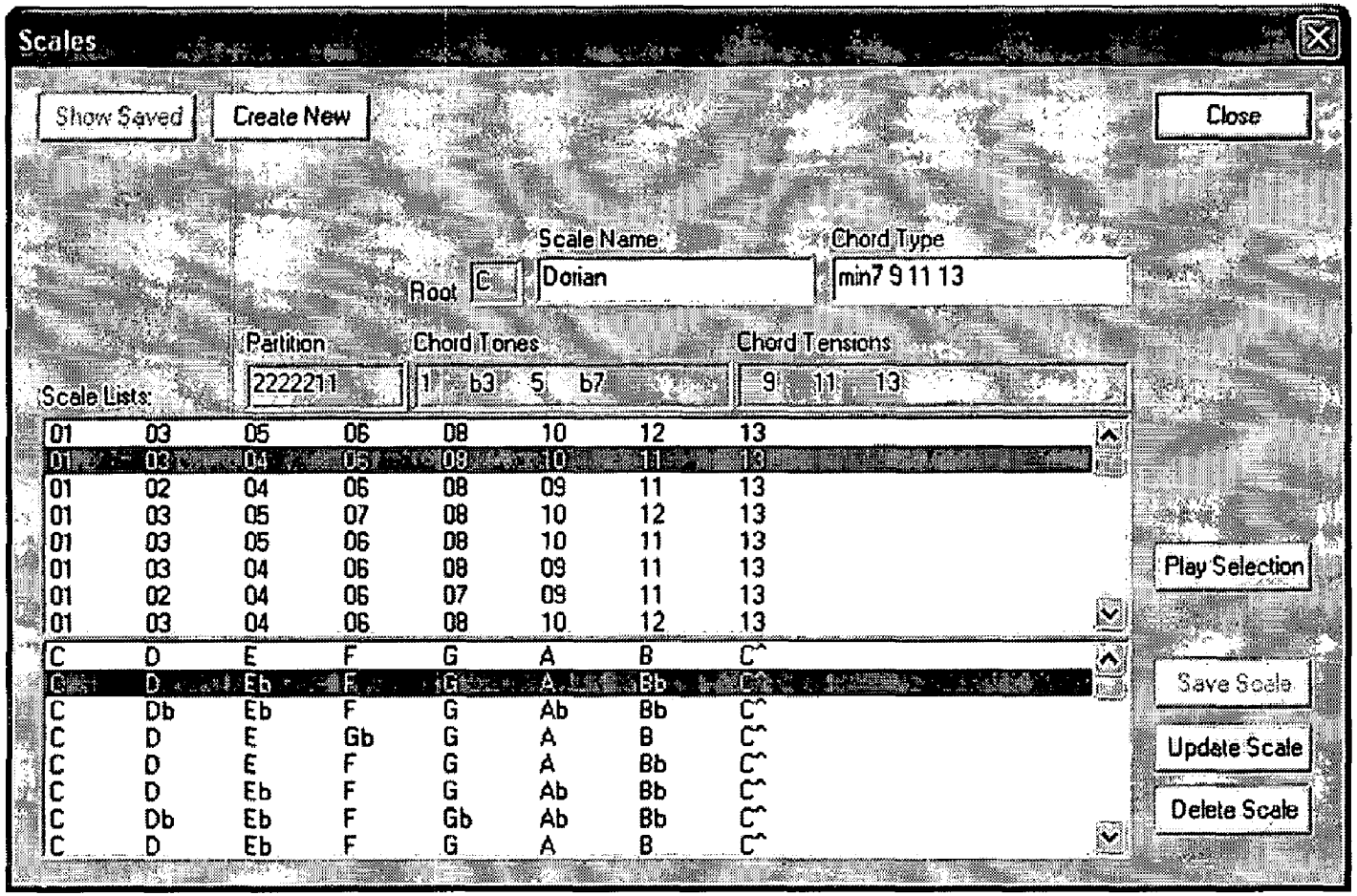
FIG. 1*c* shows a scale dialog box with to-lists that are populated with scales. The lists contain equivalent items. The selected items in the lists are equivalent.

Using selection functionality, users select a scale from a formatted list that is displayed. Because synchronization is maintained in the lists, selecting one item from one list selects the equivalent item in the other list. The selected scale in the from-list can then be added to a to-list in a dialog box (FIG. 1*c*). To-lists are formatted and displayed in the same way as from-lists. Selection of a scale in a to-list is synchronized in the same way as a from-list.

Any scale that is displayed can be selected and played. The chromatic scale numbering of the scale is translated to equivalent MIDI note decimal values so that the scale can then be played.

A scale object contains a scale and its attributes. Scale attributes identify and describe a scale that has been created. Attributes include the scale partition used to create the scale, the scale name, chord tones and chord tensions, and chord type. A unique scale name identifies the scale object.

A list of scale objects is then created and maintained in response to user actions. Add, update, and delete methods are called in response to a users corresponding action to add, update, or delete. In this way the user is enabled to create and maintain a list of preferred scales.

The add method adds a new scale object to the list for the selected scale in the from-list of the scale dialog (FIG. 1B). The scale and attributes that are entered in the scale dialog are copied to the new scale object that is being added. Scales that are commonly known are typically added along with their names and chord types. For example, C Dorian is a common scale name and mi7, 9 is an associated chord type that should be entered.

The update method allows us to edit the attributes of any scale object in the list of scale objects. To locate the scale object in the list, a search is performed using the scale name attribute. Once the scale object is found, the attributes are updated with changes that have been made in the scale dialog (FIG. 1B).

The delete method locates the scale to be deleted in the same way as the update method, and then deletes the scale object from the list of scale objects.

On clicking a save button, the state of all scale objects in the list are saved to disk. On opening the scale dialog, any scale object previously saved to disk is read into a newly allocated scale object and then it is added to a list of scale objects. Any scales that have been read from disk are displayed in the to-lists of the scale dialog (FIG. 1*c*). Attributes are displayed as well for any selected scale in the to-list.

Combinations—As is well known in the art, an algorithm is used to generate lists of numerical combinations for a given set of parameters. In the present invention, combinations that are generated are used in the following way.

Figure 2:
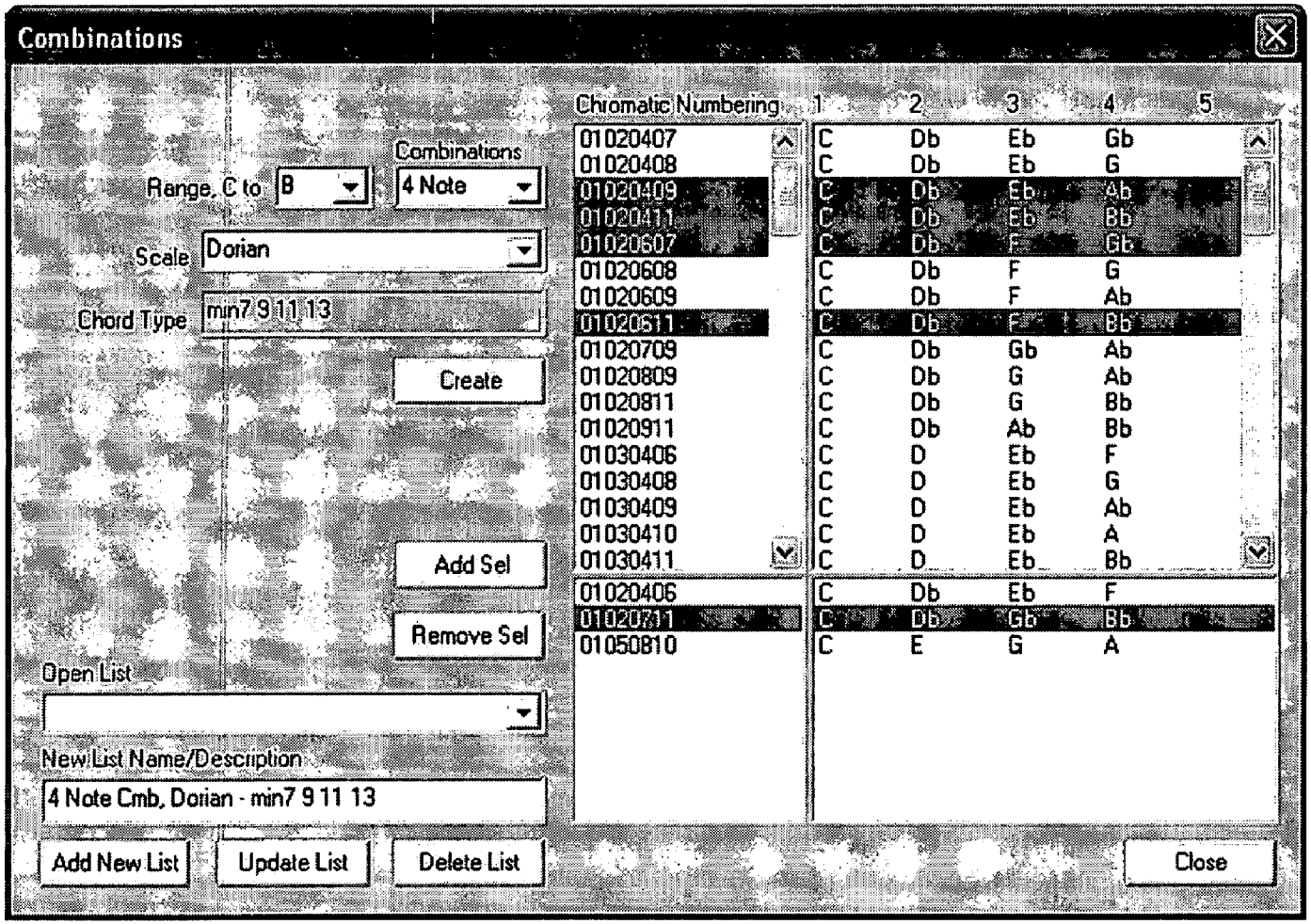
FIG. 2 shows a combinations dialog box. Combinations created for selected parameters populate a pair of from-lists where one list is formatted using chromatic scale numbering and the other with note names. A pair of to-lists is shown below where each of these lists contains three items. They are formatted in the same way as the from-lists are. Selected items in adjacent lists are equivalent.

In order to have a source of notes to construct melodies or musical licks with, users can first generate one or more lists containing combinations of musical notes (FIG. 2). Two parameters are selected by the user to limit combinations to a range and to a specified number of notes. Scales can be used to filter or limit the list of combinations returned. Conversely, if the chromatic scale is selected, all possible combinations of notes are generated for the selected parameters.

The first parameter defines the set from which subsets are made and is a set of chromatic scale tones where the parameter indicates the last note of the scale thereby setting the chromatic scale range. For this parameter users select from a list of chromatic scale tones starting from middle "C" and ending on the note "A" a major $13^{th}$ interval above middle "C". The second parameter defines a subset of the first parameter, the scale range, by designating the number of notes that a combination can have. For this parameter, the user selects from a list indicating that the combinations will have one, two, three, four, or five notes for any combination generated.

Once the parameters have been selected, combinations of musical notes can then be created by mapping numeric combinations to the chromatic scale. Numeric combinations, starting with the number 1, are mapped to each scale step where the numeric values of combinations are the same as any scale step. The first step of the chromatic scale is 1; the $2^{nd}$ step is 2; the $3^{rd}$ step is 3 and so on. Notes of the chromatic scale correspond to the scale numbering where 1 is middle C having a MIDI note decimal value of 60. Subsequent chromatic scale numbers and notes are mapped in the same way to numeric combinations for selected parameters.

For example, referring to FIG. 2, the following list of combinations is generated with these parameters. The first parameter, the range is "C" to "B". The second parameter, "4 Note", specifies that all combinations will contain four notes. The resulting combinations are 1 2 3 4, 1 2 3 5, 1 2 3 6 . . . 9 10 11 12. And the corresponding note names are C Db D Eb, C Db D E, C Db D F . . . Ab A Bb B. And the corresponding MIDI note decimal values are 60 61 62 63, 60 61 62 64, 60 61 62 65 . . . 68 69 70 71.

Upon generating the list of combinations for selected parameters, combinations are eliminated that start on any scale step other than the first step of the chromatic scale. This ensures that a list of unique combinations will be created. For example, while the chromatic scale steps 1 2 3 4 and 2 3 4 5 are different numerical combinations, they yield the same interval construction or melodic shape. Consequently they have the same melodic sound—only differing by key.

Additionally, combinations can be filtered by scale. Any user maintained scale could be selected to limit the notes of any combination to that scale. The default selection is the chromatic scale since all other scales are a subset of the chromatic scale. Any combination not found in the selected scale, that is where all the notes of the combination are not in the scale, is bypassed.

Combinations that are created are formatted and displayed in lists so that both chromatic scale numbering and equivalent note names can be shown (FIG. 2). The lists using chromatic scale numbering are sorted from low to high where the lowest items appear first in the lists. The lists maintain synchronization so that equivalent items are sequentially displayed in the same order.

Using selection functionality, users select one or more combinations from a formatted list that is displayed. Because synchronization is maintained in the lists, selecting one or more items from one list selects the equivalent items in the other list.

Any combination that is displayed can be selected and played. The chromatic scale numbering of the combination is translated to equivalent MIDI note decimal values so that the combination can then be played.

A from\to dialog allows the user to select and save preferred sounding combinations (FIG. 2). Combinations that have been formatted populate the from-lists in the dialog. Selected items can be removed and added to the to-lists. Items in the to-lists can also be selected, removed, and added to the from-lists.

A combination object contains both from-lists and to-lists, as well as attributes. Attributes include, parameters used to create combinations, the scale name used in filtering combinations, and a unique name that is provided by the user that identifies and describes the combination object.

A list of combination objects is then created and maintained in response to user actions. Add, update, and delete methods are called in response to a users corresponding action to add, update, or delete. In this way the user is enabled to create and maintain lists of combinations that they prefer.

The add method adds a new combination object to the list. The from-lists, to-lists, and attributes captured in the dialog are copied to the new combination object that is being added.

The update method allows us to update the combination object with any changes made by the user. Changes in the dialog include adding or deleting combinations in from-lists or to-lists as well as changing attributes. To locate the combination object, a search is performed using the combination name attribute. Once the combination object is found, it is updated with the changes. Also, for any combination deleted in a to-list, a permutation object is deleted having the same name attribute as the combination object being updated, and where the combination is the same in both combination and permutation objects. Note that a discussion of permutations follows this discussion of combinations.

The delete method locates the combination object in the same way as the update method. Next, the combination object is deleted from the list. Additionally, any permutation objects having the same name attribute are deleted.

The state of all combination objects in the list are saved to disk on clicking a save button. On opening the combinations dialog, combination objects previously saved to disk are read into newly allocated combination objects. Each new object is then added to an object list. A drop down list is populated and displayed with the name attribute of each combination object. If a name is selected from the list, the data stored in the combination object as previously described, is displayed on the screen.

Permutations—As is well known in the art, an algorithm is used to generate lists of permutations for a given set of numbers or letters for example. In the present invention, permutations that are generated are used in the following way.

Having created and saved a list of combinations, the items can be retrieved for the purpose of creating permutations. Permutations of combinations provide melodic variations of the combination by re-ordering the notes. For example, there are 2 permutations of the 2 musical notes A and B, namely AB and BA. And there are 6 permutations of the 3 musical notes A, B, and C, namely ABC, ACB, BAC, BCA, CAB, CBA.

Figure 3:
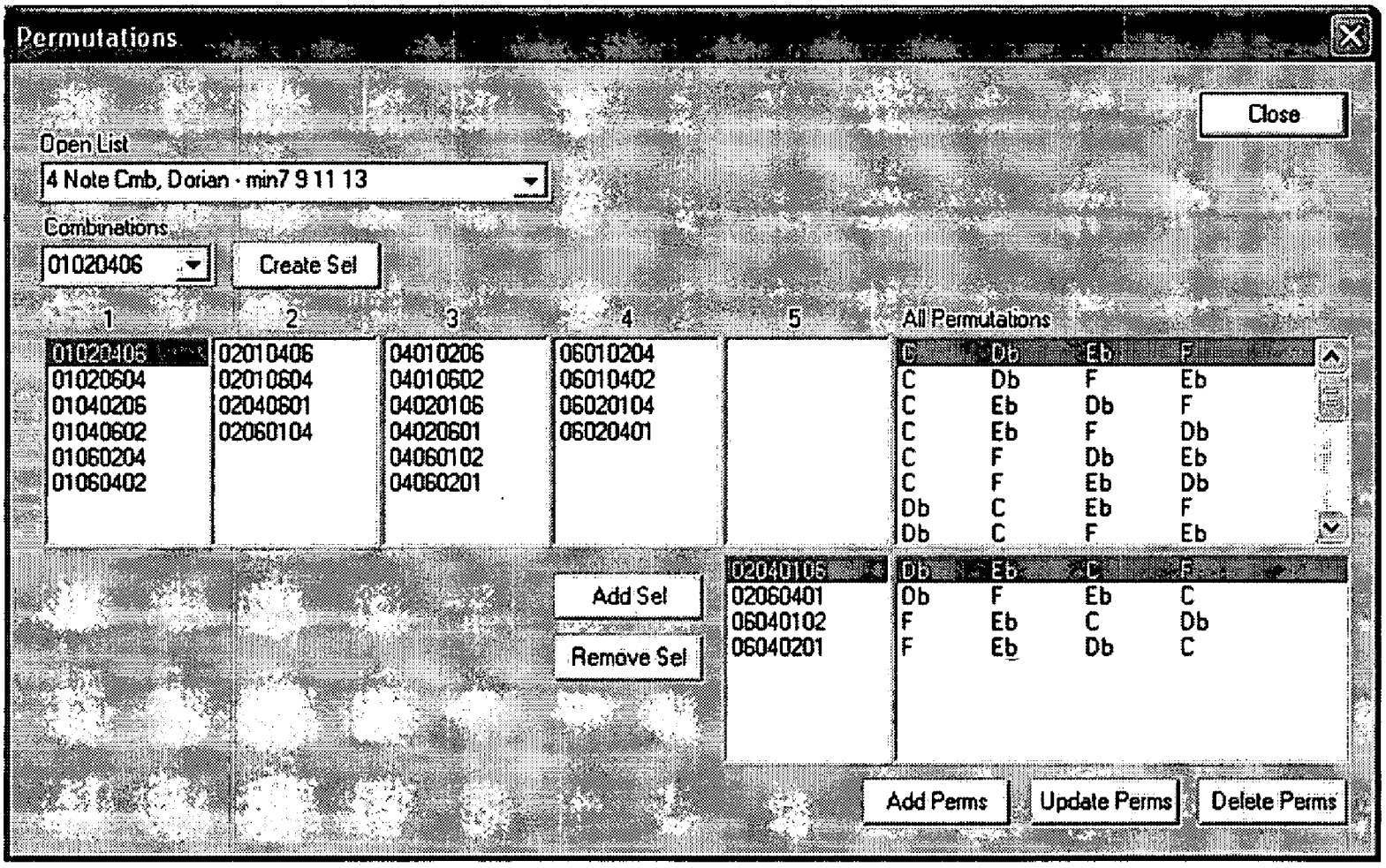
FIG. 3 shows a permutations dialog box. For the selected list name and combination, permutations that were previously saved, populate the lists. There are six from-lists and two to-lists. The to-lists are shown below the from-lists. Five of the six from-lists are used to display chromatic scale numbering of permutations. And the sixth from-list on the far right shows the equivalent note names for the items contained in the other from-lists.

Permutations of combinations also provide a source of notes to construct melodies or musical licks with. As with combinations, a from\to dialog will allow us to select and save preferred sounding permutations (FIG. 3). These permutations become one of two sources of notes that are used later to build melodies or licks.

Before creating permutations of a combination, a combination object must be retrieved. On opening the permutations from\to dialog, a combo box list is filled with the name attribute that identifies combination objects. This is accomplished by iterating through the list of combination objects that was previously saved and retrieving the name attribute. Once the user selects a name from the combo box, the list of combination objects is searched for a matching name. On finding a combination object with a matching name, all of the combinations in the to-list of the combination object are displayed in another combo box. Selecting any combination in the combo box prompts a search to see if a permutation object exists with a matching name and combination attribute. If there is not a match, permutations are generated for the selected combination and displayed in the from-lists.

Permutations that are created are formatted and displayed in lists so that both chromatic scale numbering and equivalent note names can be shown (FIG. 3). Lists using chromatic scale numbering are sorted from low to high where the lowest item appears first in the list. All lists maintain synchronization so that equivalent items are sequentially displayed in the same order.

Using selection functionality, users select one or more permutations from a list. Because synchronization is maintained in both lists selecting one or more items from one list selects the equivalent items in the other list even though the format is different. Permutations that have been created and formatted populate the from-lists in the dialog. Selected items can be removed and added to the to-lists. Items in the to-lists can also be selected, removed, and added to the from-lists.

A permutation object contains both from-lists and to-lists, as well as attributes. Attributes include the name used to identify a combination object as well as the combination from which any permutations are created.

A list of permutation objects is then created and maintained in response to user actions. Add, update, and delete methods are called in response to a users corresponding action to add, update, or delete. In this way the user is enabled to create and maintain lists of permutations that they prefer.

The add method adds a new permutation object to the list. The from-lists, to-lists, and attributes captured in the permutations dialog (FIG. 3) are copied to the new permutation object that is being added.

The update method allows us to update a permutation object with changes made by the user in the permutations dialog. Changes include adding and deleting permutations in from-lists and to-lists. To locate the permutation object, a search is performed using the permutation name attribute as well as the combination attribute. Once the permutation object is found, it is updated with the changes.

The delete method locates a permutation object in the same way as the update method. Next, the permutation object is deleted from the list.

The state of all permutation objects in the list are saved to disk on clicking a save button. On opening the permutations dialog, permutation objects previously saved to disk are read into newly allocated permutation objects. Each new object is then added to an object list. Additionally, a combo box list is filled with the name attribute of any combination objects. This is accomplished by iterating through the list of combination objects that was previously saved and retrieving the name attribute. Once a name is selected from the combo box, the list of combination objects is searched for a matching name. On finding a combination object with a matching name, all of the combinations in the to-list are displayed in another combo box. Selecting any combination in the combo box prompts a search to see if a permutation object has been created with a matching list name and combination. If so, the permutations found in the from-lists and to-lists are retrieved and displayed.

Lickparts—Lickparts can represent what you already know from your own musical playing experience. Or, they can be parts of licks or melodies that appear in some published music book for example. In either case, Lickparts in addition to permutations can be used as a source of notes to construct melodies or musical licks.

Figure 4:
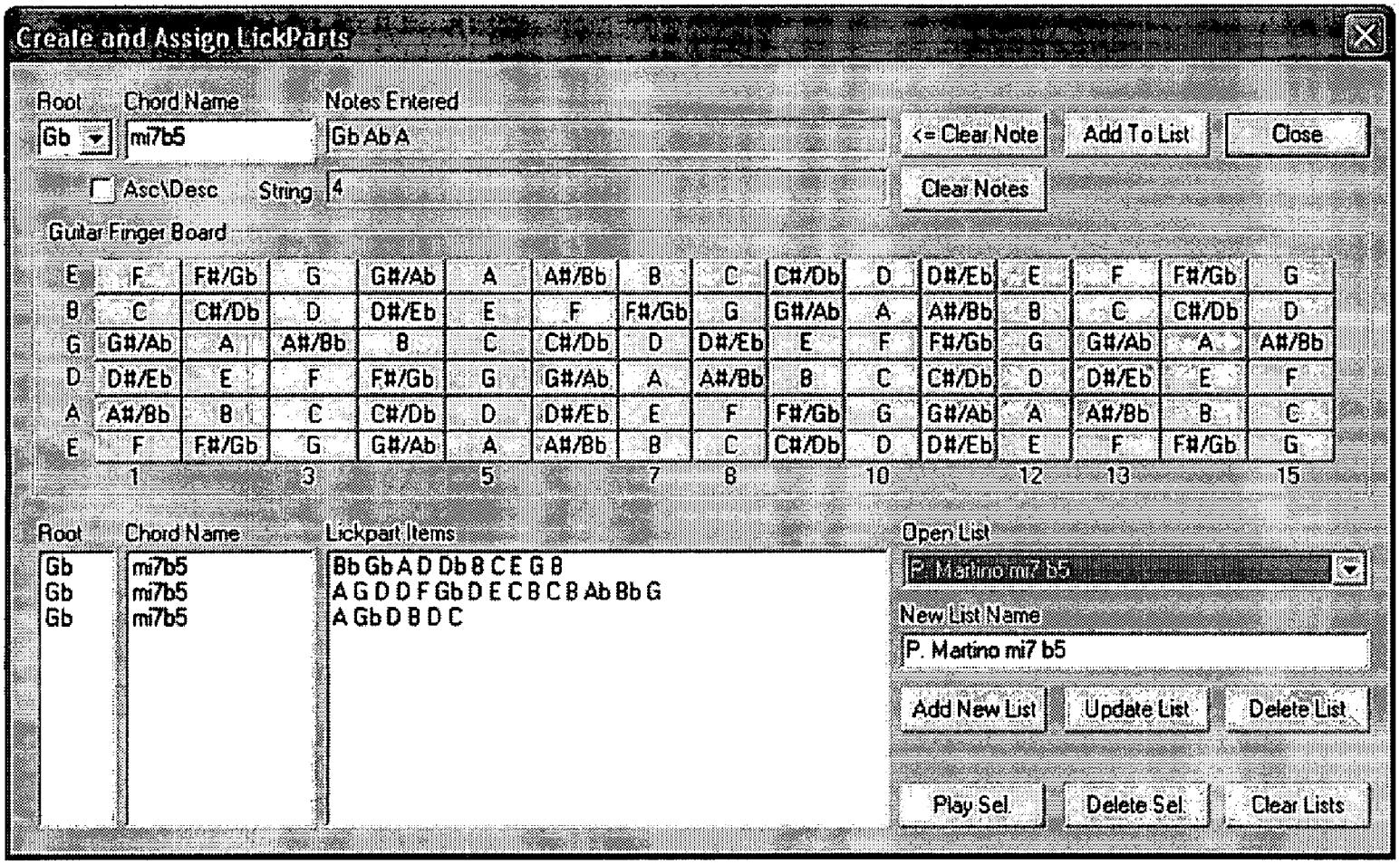
FIG. 4 shows a Lickparts dialog box. For the selected list name, Lickparts that were previously saved, populate the Lickpart Items list. Attributes that describe the Lickparts are displayed as well. A keyboard map captures user input for creating or updating Lickparts.

A dialog box is used to create Lickparts. Lickparts that have been previously saved are retrieved using the dialog box as well (FIG. 4).

Notes that comprise a Lickpart are entered using a keyboard map. Alternatively, they could be entered using a musical instrument with MIDI capability. In either case, as notes are entered and interpreted as to their name and MIDI note decimal value, the input is used and treated in the same way in creating any Lickpart.

In creating a Lickpart, the series of notes entered via the keyboard map are interpreted and the MIDI note decimal values are subsequently stored in an array. The note name equivalents of the MIDI values stored in the array are simultaneously displayed as a string in a text box providing feedback to the user.

There are two options for editing these notes. One is notes can be cleared one at a time in the reverse order that they were entered. Or, all the notes can be cleared simultaneously. In either case, additional notes can then be appended using the keyboard map. As notes are displayed, edited, and updated, they are simultaneously updated in the array storing the MIDI note decimal values.

Three options are provided to derive additional Lickparts from the current Lickpart being entered. A derived Lickpart is created by programmatically manipulating the series of notes entered in different ways. Selecting option one causes the notes to be reversed. Selecting option two, manipulates the notes by mirroring the interval sequence of the notes, and option three manipulates the notes by mirroring the interval sequence of the notes and then reversing the sequence of notes. Mirroring an interval sequence of notes reverses the direction, either by ascending or descending, of each interval formed in the note sequence.

Once the user has completed entering and editing a Lickpart, it is added to a list by clicking an add button. Any derived Lickparts are also added to the list as well. Items in the list can be selected and played or deleted.

With the Lickparts dialog (FIG. 4), the user enters attributes that describe the Lickparts. Lickpart attributes include a root, chord type, and a unique name that describes the list of Lickparts and attributes. A root is selected from a list of notes comprising the chromatic scale. And the chord type is entered as free text. By entering these two attributes, the harmonic use of the series of notes is then user defined. Also, the name attribute is captured in a text box.

A Lickpart object contains a list of Lickparts, as well as Lickpart attributes. A list of Lickpart objects is then created and maintained in response to user actions. Add, update, and delete methods are called in response to a users corresponding action to add, update, or delete. In this way the user is enabled to create and maintain lists of Lickparts that they prefer.

The add method adds a new Lickpart object to the list. The Lickpart list and attributes captured in the Lickparts dialog (FIG. 4) are copied to the new Lickpart object that is being added.

The update method allows us to update a Lickpart object with changes made in the Lickpart dialog by the user. Changes include adding or deleting Lickparts in a list. To locate the Lickpart object, a search is performed using the Lickpart name attribute. Once the Lickpart object is found, it is updated with the changes.

The delete method locates a Lickpart object in the same way as the update method. Next, the Lickpart object is deleted from the list.

The state of all Lickpart objects in the list are saved to disk on clicking a save button. On opening the Lickparts dialog, Lickpart objects previously saved to disk are read into newly allocated Lickpart objects. Each new object is then added to an object list. A drop down list is populated and displayed with the name attribute of each Lickpart object. If a name is selected from the list, the data stored in the Lickpart object as previously described, is displayed in the Lickparts dialog.

Keyboard Maps—A keyboard map, as is well known in the art, representing a guitar fingerboard, is used to capture user input with a mouse. Additionally, it is used to display and filter information that has been processed. Alternatively, keyboard maps representing other musical instruments such as piano, electric bass, or saxophone can be used in the same way.

A graphical representation of the instrument is displayed so that the user can interpret the keys or notes of each instrument. The behavior and functionality is the same for any keyboard map. Notes on the keyboard map correspond to MIDI note decimal values. Event handlers for the notes on the keyboard map interpret notes that a user may click on. If a user clicks on middle "C" for example, the note name along with the corresponding MIDI note decimal value of 60 is captured.

Figure 5:
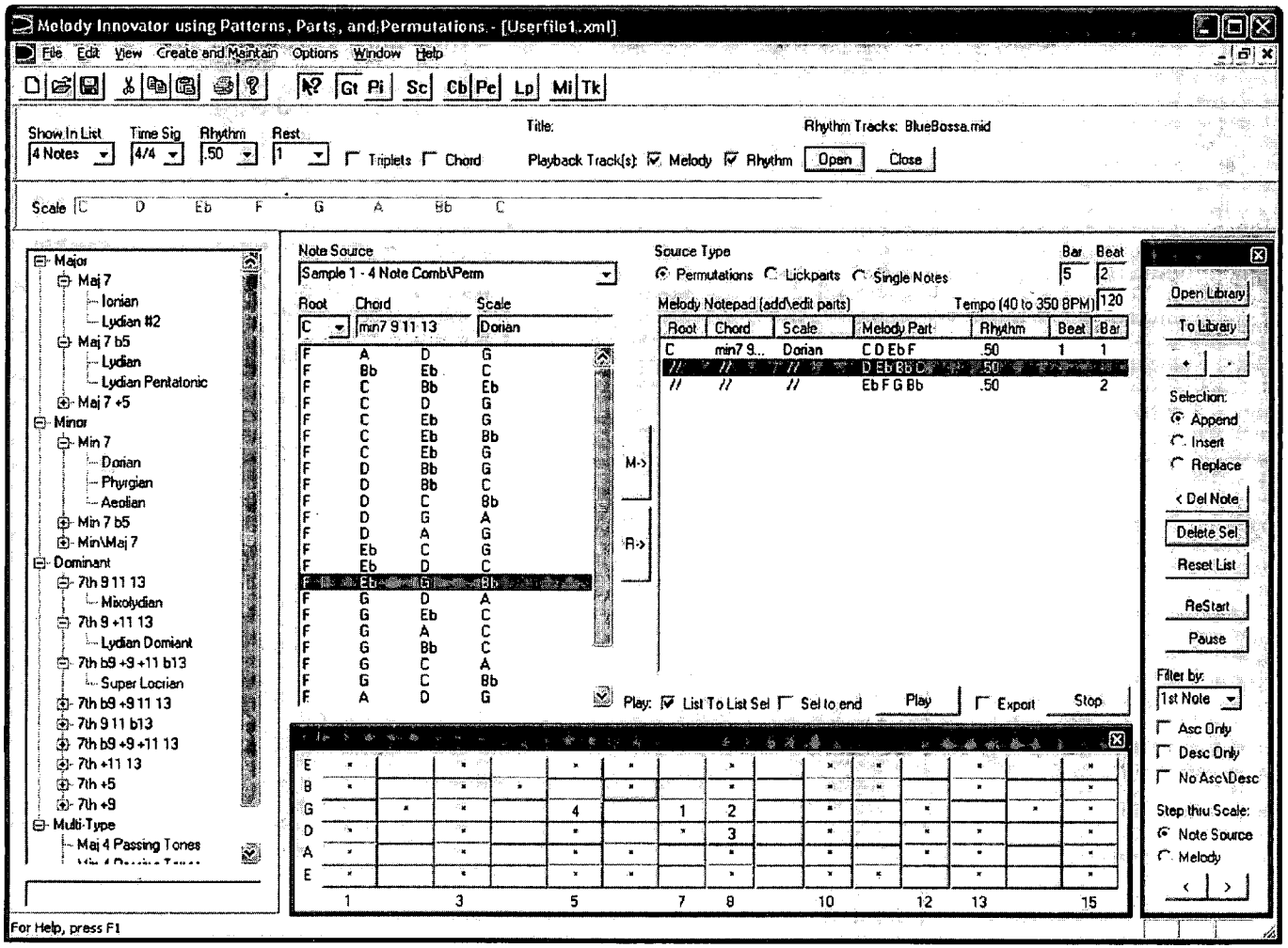

Asterisks are displayed on the keyboard map to provide information and feedback for the user (FIG. 5). Asterisks that are displayed on the guitar fingerboard indicate valid scale tones for the selected scale and root for example.

Additionally, numbers appear on the finger-board indicating the order in which notes are played back as well as the physical location of the notes sounding with regard to their pitch (FIG. 5). These appear upon selecting and playing any scale, combination, permutation, Lickpart, or melody part created or maintained by the user. The lowest number represents the first note played in the series of notes sounding. The highest number represents the last note of the series of notes sounding.

An option allows users to limit how many numbers are displayed on the keyboard. For example, if twenty notes are played back in a sequence and the limit of notes to display is ten, then numbers one through ten will be displayed for the last ten notes that sound in the sequence.

Building Musical Licks and Melodies—With the present invention, there are two sources of notes used to construct musical licks or melodies. They are namely, permutations and Lickparts. Radio buttons indicating a list type allow the user to select which source of notes to use (FIG. 5). The default list type is permutations.

If the permutations radio button is selected, a combo box list is reset and filled with list names. This is accomplished by iterating through the list of combination objects that was previously saved and retrieving the name attribute from each object. In the same way, the combo box list is reset and filled with the name attribute for any Lickpart objects when the radio button selection is Lickparts.

Additionally, if the permutations radio button is selected, another combo box list is reset and filled with scale names. This is accomplished by iterating through a list of scale objects that was previously saved and retrieving the name attribute for any scale object.

If a scale name is selected from the combo box list, asterisks are displayed on the keyboard map indicating the notes of the scale (FIG. 5). This is accomplished by iterating through the list of scale objects. On matching the selected scale name with the attribute name of the scale object, the scale is retrieved from the scale object. Additionally, the chord type attribute is retrieved and displayed as well. The values contained in the scale are used to determine which notes on the keyboard map should display an asterisk. The default key is 'C' and can be changed by selecting a different root.

There are 12 possible roots that correspond to the notes of the chromatic scale. The default root is "C". Selecting a root causes any scale that is selected to be transposed accordingly and subsequently displayed on the keyboard map.

If the Lickparts radio button is selected, as previously described, the combo box list is reset and filled with the name attribute for any Lickpart objects. On selecting a name, we iterate through the list of Lickpart objects and compare the name attribute of the Lickpart object with the selected name. On matching names, the chord type attribute is retrieved from the Lickpart object and displayed.

Processing of the Lickpart object continues. Asterisks are then displayed on the keyboard map where the note that an asterisk represents is the equivalent of the first note of a Lickpart. When a user views a keyboard map, the asterisks indicate that one or more Lickparts exist starting on a note indicated by an asterisk.

To accomplish this, iterating through the list of Lickparts retrieves the first note of every Lickpart. The notes that are retrieved are stored in an array. Any duplicate elements are eliminated. The note values contained in the array are then used to determine which notes on the keyboard map should display an asterisk.

A from-list is used to display either permutations or Lickparts (FIG. 5). As described earlier, if the selected list type is permutations, and a list name and scale name are selected, the keyboard displays asterisks. Subsequently, clicking any asterisk on the keyboard map will cause the from-list to be populated in this way.

First, any items already displayed in the from-list are removed. Permutations in the to-list of any permutation object with a name attribute matching the selected list name are retrieved while others are bypassed. Then for a selected scale name, the list of scale objects is searched. A scale object with a matching name attribute provides a lookup method called "GetPermsInScale". For any permutation not previously bypassed, the method gets any additional permutations with the same melodic shape that might occur in the scale. A simple example follows.

A permutation having the notes C, D, E, and a C Ionian scale, are passed as parameters on calling the method "GetPermsInScale". The notes of the scale are C, D, E, F, G, A, B. We want to know the following. Can other permutations be found in the C Ionian scale having the same melodic shape as the permutation passed as a parameter?

The melodic shape of the permutation in this example is a note followed by a whole step giving the second note. The second note followed by a whole step giving the third note. This melodic shape occurs three times in the scale. The first occurrence is, C, D, E, the second is F, G, A, and the third is G, A, B. Each of the occurrences has the same melodic shape or interval construction, and all of the notes are in the same scale, namely C Ionian which was passed as a parameter in this example. Therefore these permutations can be used as well to construct a musical lick or melody for the selected scale.

Processing continues for any permutations we may have at this point. If the selected root is not the default value of 'C', then the permutations are transposed by the interval difference of the selected root and the default root. The permutations are then made available for the entire range of the selected keyboard map by copying the permutation to all other octaves. Also MIDI note decimal values are mapped for each note in each permutation so that they can be played. Finally, any permutations where the first note of the permutation matches the note that was clicked on the keyboard map are loaded into the from-list list so that the user may select them to play or add to a to-list (FIG. 5).

However, if the selected list type is Lickparts, clicking any asterisk on the keyboard map will cause the from-list to be populated in this way.

First, any items already displayed in the from-list are removed. Lickparts in the list of any Lickpart object with a name attribute matching the selected list name are retrieved while others are bypassed. If the selected root is not the default value of 'C', then the Lickparts are transposed by the interval difference of the selected root and the default root. The Lickparts are then made available for the entire range of the selected keyboard map by copying the Lickpart to all other octaves. MIDI note decimal values are mapped for each note in each Lickpart so that they can be played. Any Lickparts where the first note of the Lickpart matches the note that was clicked on the keyboard map are loaded into the from-list so that the user may select them to play them or add them to the to-list.

Once the from-list has been populated with either permutations or Lickparts, items in the from-list can then be selected. Selecting any item causes it to be played and display on the keyboard map. Upon hearing the selected notes played and seeing the notes displayed on the keyboard map, the user decides whether to use the notes as part of a musical lick or melody. If so, an add button adds the selection to a to-list. Other selections in the from-list can be added to the to-list in the same way.

Attributes are stored in lists that correspond with items added to the to-list. Attributes include list type, root, scale name, and chord type and are captured from the screen shown in FIG. 5.

At this point the user can choose to re-populate the from-list with Lickparts or permutations in the manner previously described. Again, items in the from-list can be selected, played, and displayed, and then if desired, added to the to-list.

Items in the to-list form the musical lick or melody. With this iterative process, the melody grows in length as items in the from-list are selected and added to the to-list.

Clicking a play button causes all of the items in the to-list to be concatenated in the order that they were added. The newly formed string contains a series of notes where the value of each is a MIDI note decimal value. The string is passed to an object that plays MIDI strings by parsing out each of the notes in the string. The melody is subsequently played.

Additionally, using multiple selection functionality, selected items in the to-list may be played or deleted. Also, a reset button can be used to empty the to-list of any permutations or Lickparts that have been added.

Figure 6:
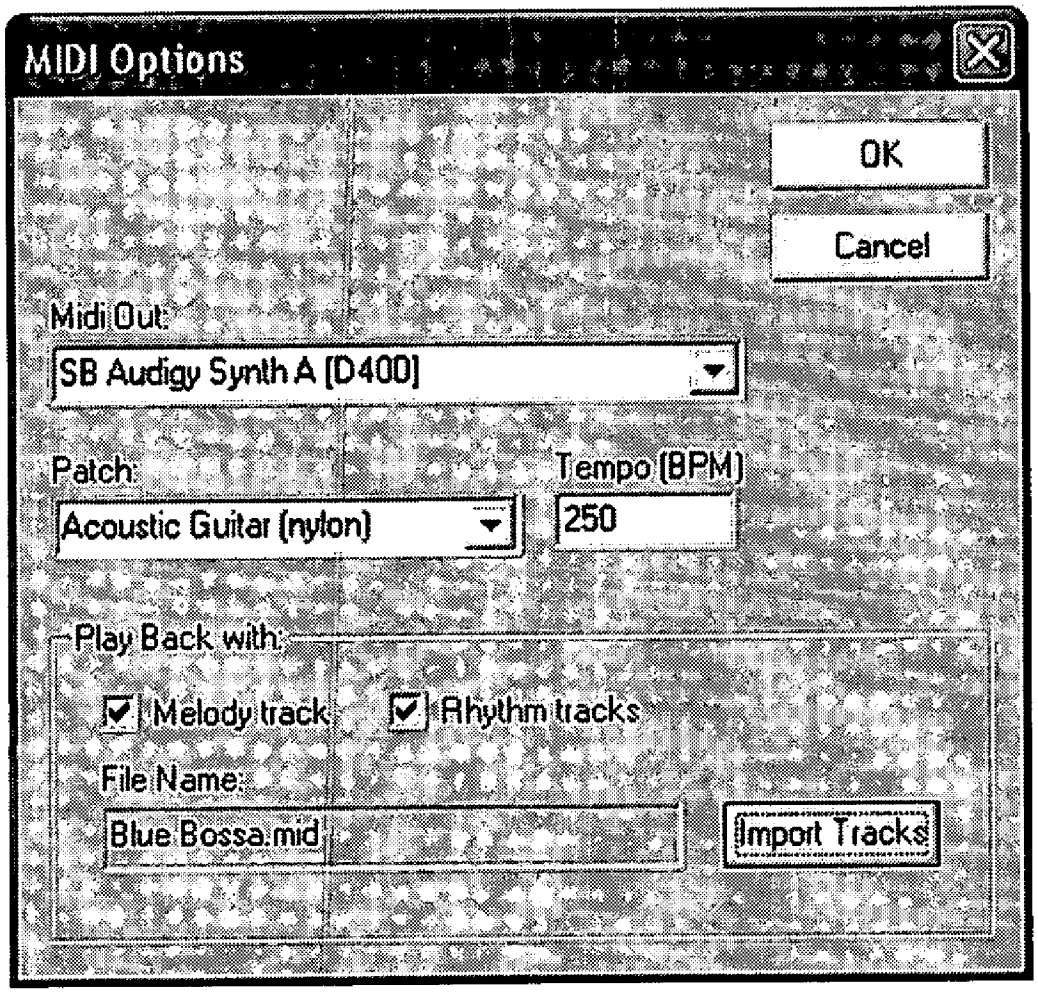
FIG. 6 shows a Midi Options dialog box that gives users the following options. One option is to play the melody that they are creating simultaneously with rhythm tracks. Additionally, the melody, or rhythm tracks may be played alone. Sample rhythm tracks are provided for the user to build melodies with. Rhythm tracks are read in as standard MIDI files. This allows the user to use a tool of choice in the market place such as a sequencer program to create there own rhythm tracks. The rhythm tracks may contain one or more instruments playing various harmonies, melodies, or both for example.

Building Musical Licks and Melodies with Rhythm Tracks—In the current invention, a standard MIDI file containing one or more tracks, can be read (FIG. 6). This program functionality is utilized in the following way.

Using a tool of choice found in the market place, such as a sequencer program, users create their own rhythm tracks. For example, the rhythm tracks might contain piano, bass, and drums playing the background to a song, or a series of favorite sounding chords. Or, they may even contain one or more melodies. Using the sequencer program, the rhythm tracks can then be saved to a standard MIDI file. Subsequently, the MIDI file can then be read by the current invention.

To facilitate the process of building a musical lick or melody, a MIDI Options dialog box (FIG. 6) provides users with several options. One option is to play back the melody that they are creating simultaneously with the rhythm tracks. Additionally, the melody, or rhythm tracks, may be played alone. Sample rhythm tracks are provided for a user to build melodies with as well.

If the option to play the melody alone is selected, the melody being created will be played back as previously described in the current invention. If the option to play rhythm tracks alone is selected, rhythm tracks that were previously created and read into the program will simply play back.

However, if the option to play melody and rhythm is selected, there are two basic ways in which a user may pursue building a melody utilizing rhythm tracks. First, by playing simultaneously, all of the melody and all of the corresponding rhythm tracks or secondly, by playing a selected portion of the melody. For this, the rhythm tracks must begin playing relative to where the selected portion of the melody begins.

The first of these two basic ways in which to build a melody while utilizing rhythm tracks, is relatively simple and straight forward. By default, both the melody and rhythm tracks each begin playing simultaneously from the beginning of the tracks and continue to the end unless the play-back is paused or stopped.

As the melody develops and grows in length with each new item added to the to-list (FIG. 5), it is heard along with the rhythm tracks. In this way, the user is enabled to determine if the melody sounds good or not with the corresponding harmony and rhythm for example. The play button causes this functionality to execute.

With the second basic way of playing melody and rhythm tracks simultaneously, two options exist. Functionality for the first of these two options is executed by leaving the check box labeled "Play: List to List Sel" unchecked and by selecting an item in the from-list (FIG. 5). The rhythm tracks are then synchronized with the selected from-list item and are played back in the following way.

That is, if there are no items in the to-list, then the notes comprising the selected item are the beginning of a new musical lick or melody. A new set of rhythm tracks is then created by copying all of the MIDI events that comprise the existing rhythm tracks. Then the new rhythm tracks simply start playing from the beginning as well as the melody track which contains the selected to-list item.

However with the first option, if there are items in the to-list (FIG. 5), the rhythm tracks will skip the equivalent amount of time for those items and begin playing from that point. A MIDI event structure contains a data member that stores time. The accumulated event time for any events that comprise the to-list items is then compared with the accumulated event time of any MIDI events contained in any one rhythm track (Table 1).

TABLE 1

| | |
|---|---|
| 1. To-list total melody time: accumulate midi event time for melody track or portion of melody prior to selection. | |
| Melody Track Events: | event1.time + event2.time |
| 2. Skip equivalent rhythm track time and adjust any differences. | |
| Rhythm Track 1 Events: | event1.time + event2.time |
| Rhythm Track 2 Events: | event1.time + event2.time + event3.time |
| Rhythm Track 3 Events: | event1.time |
| 3. Start playing rhythm tracks along with the selected melody in the from-list | |
| Melody Track Events: | event1 to end |
| Rhythm Track 1 Events: | none |
| Rhythm Track 2 Events: | event3 to end |
| Rhythm Track 3 Events: | none |

Table 1. Illustrates playing the selected from-list item with rhythm tracks so that the rhythm tracks start playing after the last MIDI event would have played in the to-list. If an item is selected in the to-list, then the portion of the melody prior to the selected item is not played as well as any corresponding MIDI events that exist in the rhythm tracks.

Once the accumulated event time of a rhythm track is equal to, or exceeds the accumulated event time of the to-list items, we must perform an additional test. That is, if this is the first time the condition has been met and the event time of the rhythm track event being processed is greater than zero, we must compute the adjusted event time. Otherwise the existing event time is used.

To compute the adjusted event time, the accumulated to-list event time is subtracted from the accumulated rhythm event time. The remainder becomes the adjusted event time for the rhythm track event being processed.

A new MIDI event structure is then created containing either the adjusted or existing event time. Other member data contained in the MIDI event being processed is copied to this new MIDI event. Then, the new event is inserted into the new rhythm track.

Additionally, all non-note events must also be copied and inserted into the new rhythm tracks as well. The event time for these events will be zero and the status member of the MIDI event structure will be set to the equivalent of a note-off for any channel. For this, the accumulated event time of a rhythm track is not compared with accumulated event time of the melody.

A new set of rhythm tracks are then created containing only the needed MIDI events including any adjusted event timing. In this way, we synchronize the melody and rhythm tracks to musically correspond with one another.

With the second option, functionality is executed by first checking the check box labeled "Play: List to List Sel". Then an item in the to-list (FIG. 5) must be selected which indicates the point at which the melody and rhythm should begin playing from. And finally, by selecting an item in the from-list (FIG. 5), the melody and rhythm will begin playing (FIG. 7).

To further explain the second option, rhythm tracks are synchronized, as previously described, with the selected portion of the melody that has already been formed in the to-list as well as the currently selected item in the from-list.

In other words, all of the items in the to-list (FIG. 5), starting with the currently selected item, to the last item in the to-list, are concatenated in the order that they appear. Then, the currently selected item in the from-list is appended to the concatenated to-list items to form the melody. Rhythm tracks are then synchronized to start playing where this selected portion of the melody begins (FIG. 7). The melody and rhythm tracks will play to their end or until the user stops the play-back.

With this option, the portion of the melody that is skipped, are any items in the to-list (FIG. 5) that are prior to a selected to-list item. Therefore, the equivalent portion of the rhythm tracks must be skipped as well.

Saving and Maintaining Musical Licks or Melodies—A lick object contains a list of lick items that comprise the lick, as well as attributes. A name attribute uniquely identifies the lick object. Other attributes include list type, root, scale name, and chord type. These attributes correspond with each lick item that is added to the list.

A list of lick objects is then created and maintained in response to user actions. Add, update, and delete methods are called in response to a users corresponding action to add, update, or delete. In this way the user is enabled to create and maintain lists of licks that meet their preference.

The add method adds a new lick object to the list. To-list items and corresponding attributes that are captured with the screen shown in FIG. 5 are copied to the new lick object that is being added. Items in the to-list are added to the list of lick items in the lick object. The user provides a unique name or description that identifies the lick object. This name is copied to the name attribute of the lick object.

The update method allows us to update the lick object with any changes made by the user. Changes include adding or deleting items in the to-list shown in FIG. 5 as well as changing any corresponding attributes of those items. To locate the lick object, a search is performed using the lick name attribute. Once the lick object is found, it is updated with the changes.

The delete method locates the lick object in the same way as the update method. Next, the lick object is deleted from the list.

The state of all lick objects in the list are saved to disk on clicking a save button. On opening the application's main screen, lick objects previously saved to disk are read into newly allocated lick objects. Each new object is then added to an object list. A drop down list is populated and displayed with the name attribute of each lick object. If a name is selected from the list, the data stored in the lick object as previously described, is displayed on the screen and can consequently be updated.

Alternative Embodiments

In the preferred embodiment users create musical licks or melodies with data that they have created using the supplied program functionality. For example, they create scales that are then used to determine the harmonic use of combinations and permutations. Combinations are created for selected parameters so that permutations can be created from them to serve as a source of notes. Lickparts and their harmonic use are also entered by the user to serve as a source of notes.

However in alternative embodiments, any or all of this data can be supplied with the application so that the functionality to create scales, combinations, permutations, and Lickparts is not needed. In this way the data source is manually created using a text editor or some other means for example and then stored in a file. In the computer programming field, this is known as hard-coding.

For example, one or more hard-coded lists would contain permutations or Lickparts, or any short grouping of notes for example. If scales are also hard-coded, then as with the preferred embodiment, the harmonic use of permutations or Lickparts can be determined. If scales are not provided through hard-coding, then the harmonic use of the Lickparts or permutations is hard-coded as well.

The hard-coded data source is substituted for permutations and Lickparts and then used in the same way as described in the preferred embodiment following the heading Building Musical Licks and Melodies. So the data would be used to populate the from-list shown in FIG. 5. Subsequently, items selected in the from-list are added to the to-list so they can be used to build musical licks and melodies.

Therefore, although the invention has been described as setting forth specific embodiments thereof, the invention is not limited thereto. Changes in the details may be made within the spirit and the scope of the invention, said spirit and scope to be construed broadly and not to be limited except by the character of the claims appended hereto.

I claim:

1. A method for building a musical melody using a digital computer, the method comprising the acts of:

a) selecting a first set of notes from a first displayed list of note sets wherein the first displayed list of note sets is derived by selecting a range parameter of the chromatic scale and a number parameter of total notes to be selected in said range parameter to establish a sequence of notes; and b) creating combinations of the sequences of notes;

c) selecting one or more of said combinations of sequence of notes and forming permutations of said combinations;

d) selecting one or more permutations of said combinations and placing said permutations into a second displayed list;

e) transposing one or more permutations in the second displayed list to all other octaves within the range of a selected musical instrument and then adding said transposed permutations to said second displayed list;

f) selecting one or more said permutations and transposed permutations successively to a third displayed list, and concatenating said sets of permutations and transposed permutations on said third displayed list to previously selected sequences of permutations and transposed permutations; and g) evaluating a result of said concatenated sets of permutations and transposed permutations in an audible manner.

2. The method of claim 1 wherein the displayed list of one or more permutations and transposed permutation note sets are filtered through a user selected musical scale and only those notes in said note sets that are consistent with said user selected scale are displayed with additional permutations constructed and displayed if for a given permutation already in the list, its interval construction forms another note set that occurs elsewhere in the user selected scale.

* * * * *